US007097373B2

(12) United States Patent
Mochizuki et al.

(10) Patent No.: US 7,097,373 B2
(45) Date of Patent: Aug. 29, 2006

(54) PRINTER

(75) Inventors: Yasufumi Mochizuki, Shizuoka (JP); Yuji Masuda, Shizuoka (JP)

(73) Assignee: Star Micronics Co., Ltd., Shizuoka (JP)

( * ) Notice: Subject to any disclaimer, the term of this patent is extended or adjusted under 35 U.S.C. 154(b) by 106 days.

(21) Appl. No.: 11/001,273

(22) Filed: Dec. 1, 2004

(65) Prior Publication Data

US 2005/0127594 A1 Jun. 16, 2005

(30) Foreign Application Priority Data

Dec. 12, 2003 (JP) ..... 2003-415791

(51) Int. Cl.
*B41J 11/66* (2006.01)

(52) U.S. Cl. ..... 400/621; 400/593; 83/94

(58) Field of Classification Search ..... 400/621, 400/621.1, 593; 83/94; 101/66, 67, 68
See application file for complete search history.

(56) References Cited

U.S. PATENT DOCUMENTS 6,113,293 A * 9/2000 Schanke et al. ..... 400/621
6,118,469 A 9/2000 Hosomi
6,652,173 B1 * 11/2003 Martini et al. ..... 400/621
2002/0056354 A1 5/2002 Morita et al.
2005/0036820 A1 * 2/2005 Watanabe et al. ..... 400/621
2005/0207818 A1 * 9/2005 Tsuchiya et al. ..... 400/621

FOREIGN PATENT DOCUMENTS

JP 56-093579 7/1981
JP 2000-103566 4/2000

* cited by examiner

*Primary Examiner*—Ren Yan
*Assistant Examiner*—Dave A. Ghatt
(74) *Attorney, Agent, or Firm*—Pearne & Gordon LLP

(57) ABSTRACT

A printer including a cutting portion including a plate-shaped fixed blade, a plate-shaped movable blade and a driving unit, which drives the movable blade back and forth with respect to the fixed blade; and a paper stacking portion for stacking a cut-off paper thereon, which is provided on a downstream side of a paper transfer direction with respect to the cutting portion on the fixed blade side, wherein the movable blade is disposed on the downstream side with respect to the fixed blade and configured to move toward the fixed blade to cut a paper, and a tip end portion of the movable blade is configured to have a surface almost perpendicular with respect to a direction of pushing the paper toward the paper stacking portion.

9 Claims, 5 Drawing Sheets

PRINTER

BACKGROUND OF THE INVENTION

1. Field of the Invention

The present invention relates to a printer having a paper cutting portion and a paper stacking portion.

2. Description of the Related Art

Conventionally, in an image forming apparatus such as a printer, various considerations have been made as to a stacking of papers called a printing media, a recording paper, and so on.

There has been an apparatus in which a supporting plate is provided at a medium pressing member, which is provided on a base of a medium stacker, and a pressing plate having a thin belt-shape made of an elastic material is provided so as to be held by the supporting plate, thereby receiving printing media on the base orderly (refer to JP-A-56-93579, for example). Further, there has been an image forming apparatus having a paper cutting mechanism called a pizza cutter, in which an operation portion of a paper pressing portion and a push-down portion is provided at a moving body of the pizza cutter thereby to drop recording papers on a tray (refer to JP-A-2000-103566, for example).

SUMMARY OF THE INVENTION

However, in the conventional printers, a stacking structure of recording papers is complicated and large in size, or it is required to provide a moving portion such as a moving body of a pizza cutter, which moves in a paper width direction. Thus, it is difficult to miniaturize a size of the conventional stacking structure, particularly it is difficult to apply the conventional stacking structure to a printer having a guillotine cutter.

Accordingly, the invention intends to achieve a printer having a stacking structure which is simple in its configuration and can be easily employed even in a printer having a guillotine cutter.

To achieve the above objects, according to the invention, there is provided a printer including: a cutting portion including a plate-shaped fixed blade, a plate-shaped movable blade and a driving unit, which drives the movable blade back and forth with respect to the fixed blade; and a paper stacking portion for stacking a cut-off paper that is entirely cut off from the paper thereon, which is provided on a downstream side of a paper transfer direction with respect to the cutting portion on the fixed blade side, wherein the movable blade is disposed on the downstream side with respect to the fixed blade and configured to move toward the fixed blade to cut a paper, and a tip end portion of the movable blade is configured to have a surface almost perpendicular with respect to a direction of pushing the paper toward the paper stacking portion. According to such a configuration, the tip end portion of the movable blade can surely push the cut-off paper toward the paper stacking portion, whereby each cut-off paper can be disposed in good order on the paper stacking portion with a simple configuration.

Alternatively, there is provided a printer including: a cutting portion including a plate-shaped fixed blade, a plate-shaped movable blade, which is cut a paper with the fixed blade by an approach movement toward the fixed blade in a overlapping state, and a driving unit, which drives the movable blade back and forth with respect to the fixed blade; a paper stacking portion for stacking a cut-off paper that is entirely cut off from the paper thereon, which is provided on a downstream side of a paper transfer direction with respect to the cutting portion; and a moving portion for moving the cut-off paper to the paper stacking portion, wherein the moving portion moves the cut-off paper to the paper stacking portion along a downstream side surface of the fixed blade in accordance with a movement of the cutting portion. According to such a configuration, the cutting portion and the moving unit are operated in interlocked manner, whereby the configuration of the moving unit can be simplified and each cut-off paper can be stacked in order on the paper stacking portion.

The moving unit is configured with the movable blade. Thus, each cut-off paper can be stacked in order on the paper stacking portion with a simple configuration by practically using the movement of the movable blade.

When the printer is configured that the blade edge of the movable blade forms a V-shape in manner of that both sides thereof are led toward the fixed blade from a center portion thereof, left and right sides of the paper can be pushed with the same pressure by this V-shape configuration, whereby each cut-off paper can be more surely stacked at the center in order.

When the printer is configured to further includes a paper push-in member which is provided on the downstream side with respect to the cutting portion and protrudes toward the paper stacking portion, the cut-off paper can be stacked on the paper stacking portion more surely and further each cut-off paper orderly stacked on the paper stacking portion can be prevented from warping and falling.

According to the printer of the invention, since the paper is configured to be moved toward the paper stacking portion by using the cutting portion, each cut-off paper can be stacked on the paper stacking portion in good order with a simple configuration.

BRIEF DESCRIPTION OF THE DRAWING

These and other objects and advantages of this invention will become more fully apparent from the following detailed description taken with the accompanying drawings in which.

DETAILED DESCRIPTION OF THE PREFERRED EMBODIMENTS

Hereinafter, an embodiment of the invention will be explained with reference to accompanying drawings.

Figure 1:
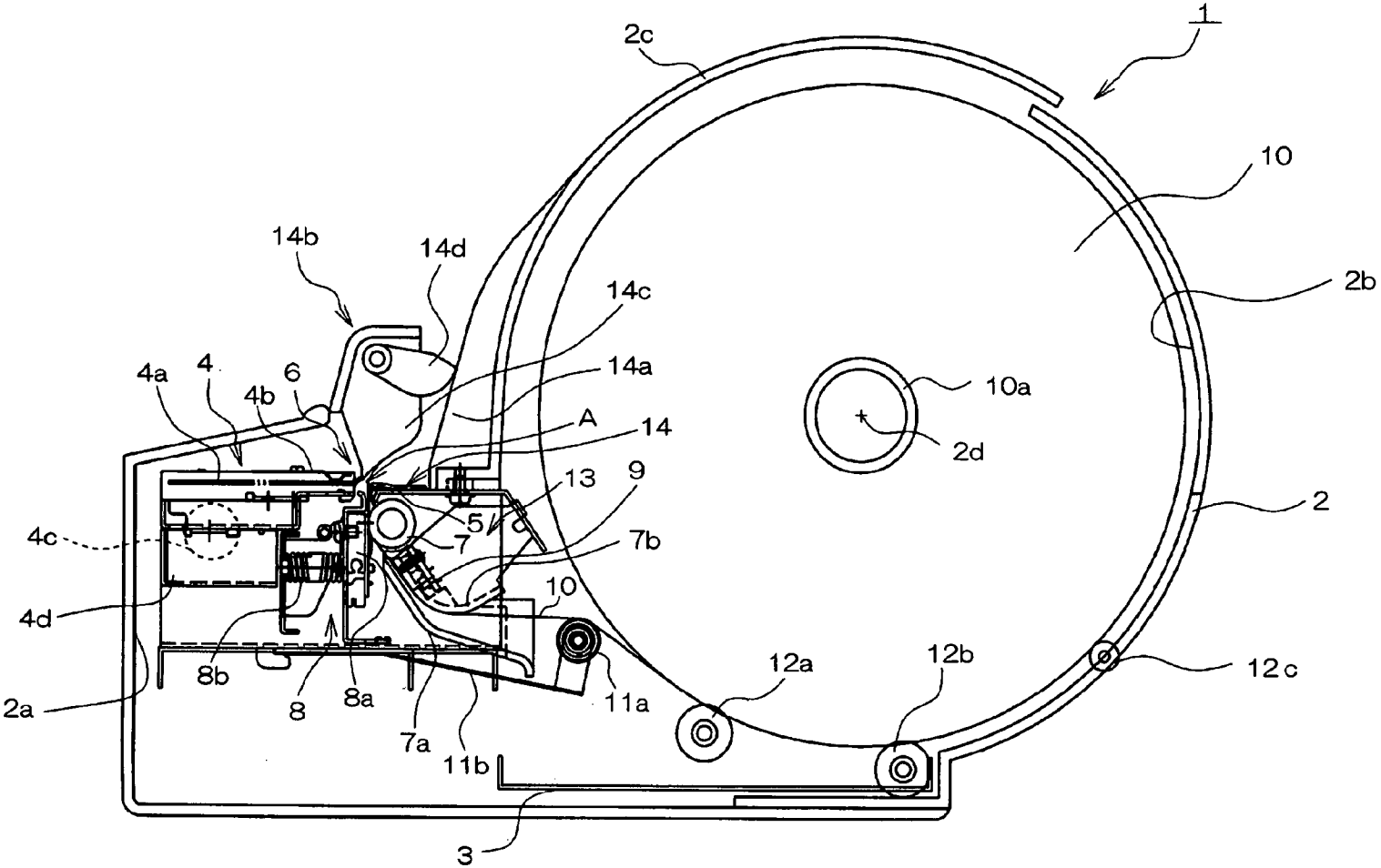
FIG. 1 is a vertical cross-sectional view of a printer according to an embodiment of the invention and shows a paper standby state at an initial stage.

FIG. 1 is a vertical cross-sectional view of a printer according to an embodiment of the invention and shows a paper standby state at an initial stage. A printer 1 has an apparatus housing portion 2*a* and a roll paper housing portion 2*b* within a casing 2. A cover portion 2*c* is attached to the casing 2 so as to be rotatably opened and closed around a shaft 2*d*. A cutting portion 6 is configured with a movable blade unit 4 and a fixed blade 5. The movable blade unit 4 is attached to a base chassis unit 3 inside of the apparatus housing portion 2*a*. The movable blade unit 4 includes a movable blade driving motor 4*c* shown by a dotted line, a movable blade 4*a* driven by the motor 4*c* and a movable blade pressing spring 4*b*. The fixed blade 5 is fixed to the cover portion 2*c*.

A printing portion 8 is attached to a base chassis 3 under the movable blade unit 4. In this embodiment, the printing portion 8 includes a thermal head 8*a* and a spring 8*b* for pressing the thermal head to a paper. Further, a motor 4*d* for driving a platen 7, which transfers or draws the paper, is attached under the movable blade unit 4. The platen 7 is attached to the cover portion 2*c* and configured with a rubber roller in this embodiment. In this case, a paper drawing portion 13 is configured with the platen 7 and a surface of the printing portion 8 opposing to the platen 7.

A paper 10, which is a roll of thermal paper 10 in this embodiment, is housed within the roll paper housing portion 2*b* and supported by supporting rollers 12*a* and 12*b*, which are attached to the base chassis 3. An auxiliary roller 12*c* attached to the casing 2 also supports the roll paper 10. The roll paper 10 is drawn by the action of a rotational drive of the platen 7 driven by the motor 4*d*, which is a step motor in this embodiment. The roll paper 10 is removed its loosing state by a damper roller 11*a* supported by a supporting spring 11*b* fixed to the base chassis 3 and is drawn through a gap between a lower guide 7*a* provided on the apparatus housing portion 2*a* side and an upper guide 7*b* provided on the cover portion 2*c* side. A detecting portion 9 for detecting the presence or non-presence of a paper is disposed to the upper guide 7*b*. FIG. 1 shows a case where the printer 1 is in the standby state, and a tip end of the roll paper 10 is located a position A between the movable blade 4*a* and the fixed blade 5.

A paper stacking portion (paper stock portion) 14 is provided on the cover portion 2C positioned on a downstream side of a paper transfer direction with respect to the cutting portion 6, which is configured with a downstream side surface 5C of the fixed blade 5 (See FIG. 7) and a paper guide member 14*a*. Further, a paper push-in member 14*b* protruding toward the paper stacking portion 14 is provided on the downstream side with respect to the cutting portion 6. In this embodiment, the paper push-in member 14*b* includes a paper guide member 14*c* and a paper holding lever 14*d*, which is a cantilever type and capable of rotating freely, but the paper push-in member may be constituted by only one of these members.

Figure 4:
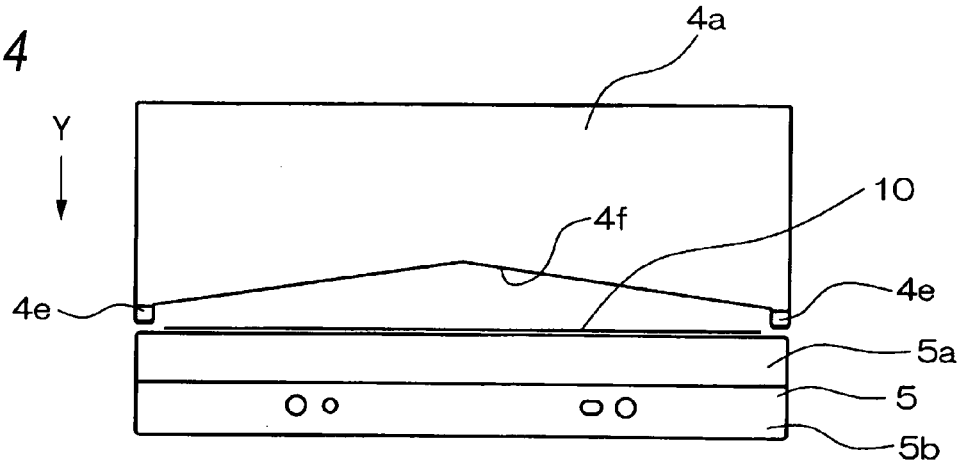
FIG. 4 is a plan view showing a relation among a movable blade, a fixed blade and the paper according to the embodiment of FIG. 1, and shows a cutting operation standby state.
Figure 7:
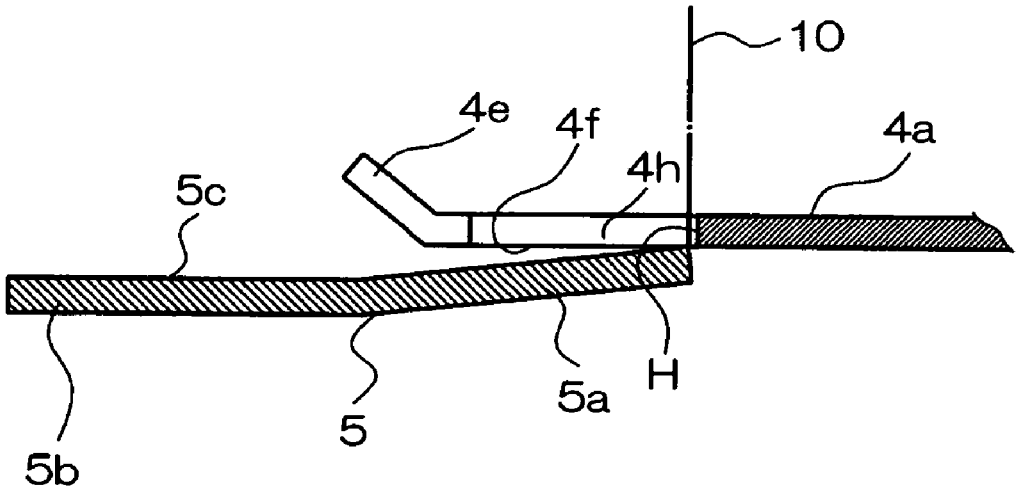
FIG. 7 is a cross-sectional view showing a relation between the movable blade and the fixed blade as viewed from an opposite side of the printer 1 shown in FIG. 1 according to the embodiment of FIG. 1, and shows a state at the time of completion of the cutting operation.

Next, the movable blade 4*a* and the fixed blade 5 of the cutting portion 6 will be explained with reference to FIGS. 4 and 7. FIG. 4 is a plan view showing a relation among the movable blade, the fixed blade and the paper 10 and shows a cutting operation standby state. FIG. 7 is an enlarged cross-sectional view showing a relation between the movable blade 4*a* and the fixed blade 5 as viewed from an opposite side of the printer 1 shown in FIG. 1, and shows a state at the time of completion of the cutting operation. A cross-section of the paper 10 at a cutting point is shown by an alternate long and short dash line.

The fixed blade 5 and the movable blade 4*a* configure a so-called guillotine cutter. The fixed blade 5 has a plate shape and includes a base portion 5*b* and a blade edge portion 5*a* slightly bending toward the downstream side from the base portion 5*b*. The movable blade 4*a* also has a plate shape basically, and includes guide portions 4*e* at both edge corners, which is bending toward the downstream side opposing to the blade edge portion 5*a* of the fixed blade 5 (see FIG. 7). A blade edge 4*f* of the movable blade 4*a* is formed a V-shape in manner of that both sides of the blade edge 4*f* are led toward the fixed blade 5 from a center portion of the blade edge 4*f*. A tip end portion 4*h* of the movable blade 4*a* has a cross-section H, which is almost perpendicular with respect to a paper push-in direction. In this embodiment, the movable blade 4*a* also serves as a moving method for moving a cut-off paper, which is fully cut off from the paper 10 to the paper stacking portion 14.

Next, an operation of the printer according to the embodiment will be explained.

Figure 2:
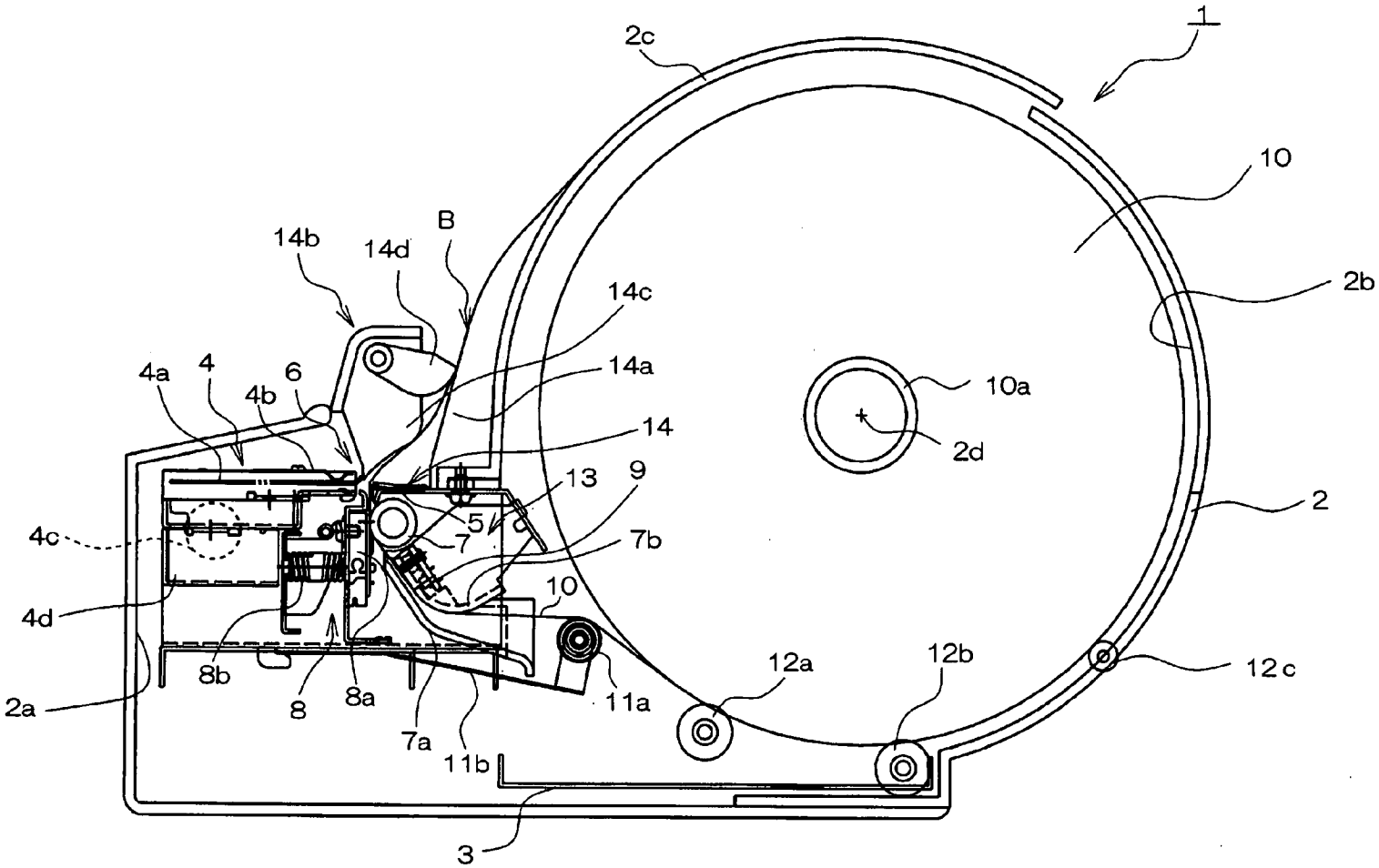
FIG. 2 is a vertical cross-sectional view of the printer showing a printing state according to the embodiment of FIG. 1.
Figure 3:
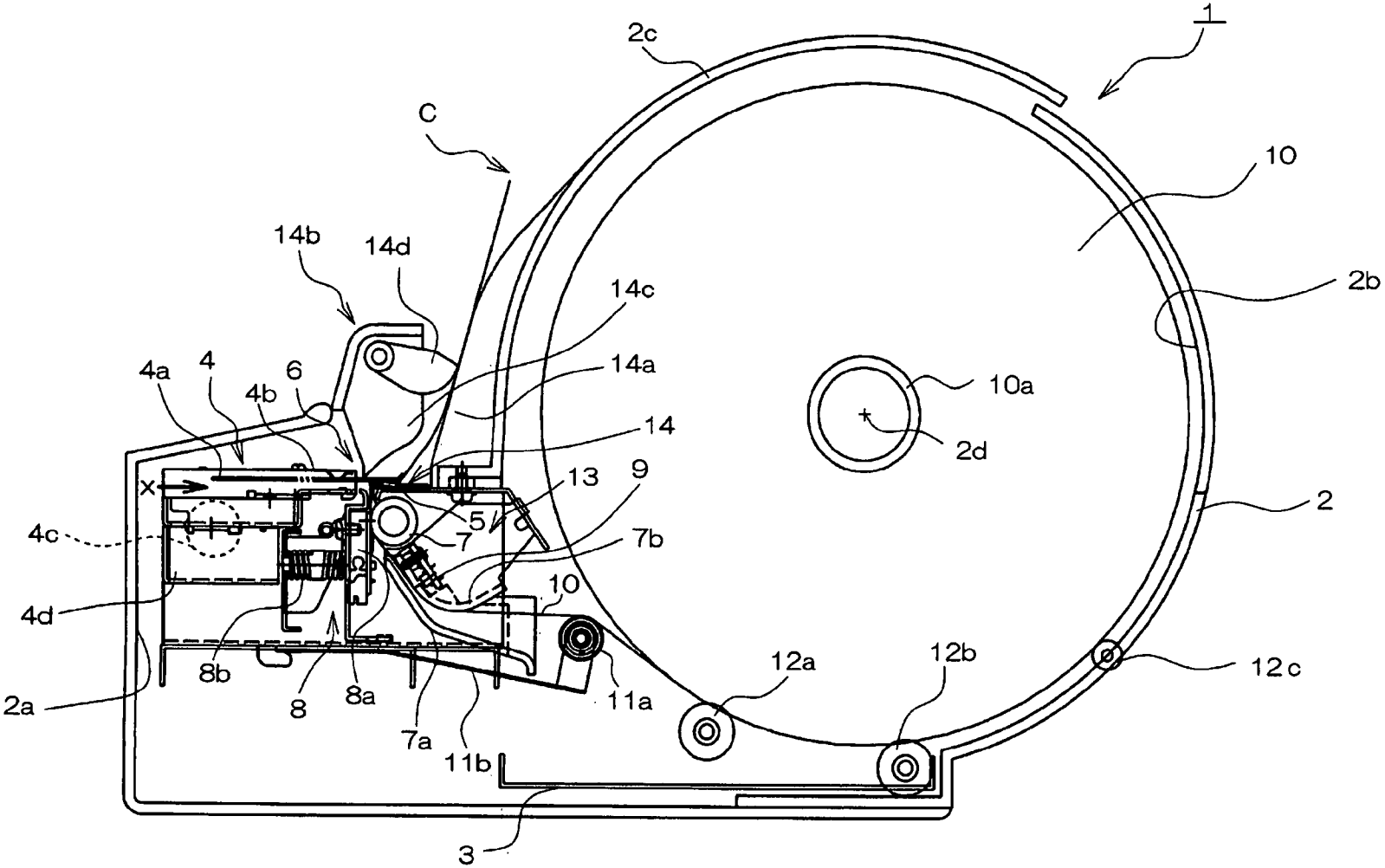
FIG. 3 is a vertical cross-sectional view of the printer according to the embodiment of FIG. 1 showing a state where printing and cutting operations of a paper are completed and the paper is being transferred.

First, in FIGS. 1 to 3, FIG. 1 shows a paper standby state at an initial stage, wherein the tip end of the paper 10 is positioned at a position A where a printed paper was cut last time. When a print command signal is sent to the printer 1 on the paper standby state shown in FIG. 1, the thermal head 8*a* for performing printing and the platen 7 disposed opposite to the thermal head 8*a* perform printing to the paper 10 and simultaneously transfer (draw) the paper 10 to the downstream side. Thus, the paper 10 rotates on the supporting rollers 12*a*, 12*b* and an auxiliary roller 12*c*, then is adjusted its loosing state by the damper roller 11*a*, then guided through the lower guide 7*a* and the upper guide 7*b* and drawn out.

The guillotine cutter configured with the fixed blade 5 and the movable blade 4*a* as described above is disposed at the downstream side with respect to the thermal head 8*a* and the paper guide member 14C is disposed so as to configure a paper path having a step to a right direction in FIG. 1 with respect to a cutting position of the paper 10 (a position of a tip end of the fixed blade 5).

The tip end of the paper 10 moves to the paper stacking portion 14 as shown in FIG. 2 while being controlled by the paper guide member 14*c*. FIG. 2 shows a state where the tip end of the paper 10 moves over the paper pressing lever 14*d* and reaches a position B. Further, when the printing operation is performed and all the printing operation is completed, a paper transfer operation stops. Next, the cutting operation of the paper 10 is performed by the guillotine cutter. As shown in FIG. 3, when the movable blade 4*a* slides in a direction of an arrow X in FIG. 3 (approach movement) and overlaps on the downstream side of the fixed blade 5, a part of the paper 10 having been printed (a printed paper) is cut off by the movable blade 4*a* and the fixed blade 5. Simultaneously, a rear end of the cut-off paper, which is an upstream side of the paper transfer direction, is sent to the paper stacking portion 14 by a sliding movement of the movable blade 4*a*. The cut-off paper is stayed at the paper stacking portion 14 by the action of the paper guide member 14*a* and the paper push-in member 14*b*, and rigidity of the cut-off paper itself, thereby a paper issuing operation is completed.

Further, even if there are other cut-off papers having been issued previously on the paper stacking portion 14, since the cut-off papers are held by the paper guide member 14*c* having the step with respect to the cutting position, a tip end of the next cut-off paper can be stacked sequentially on the cut-off papers having been held. In this way, a stacking function of cut-off papers can be achieved.

Next, a cutting and stacking actions (operations) will be explained in detail based on FIGS. 3 and 4 to 7.

Figure 5:
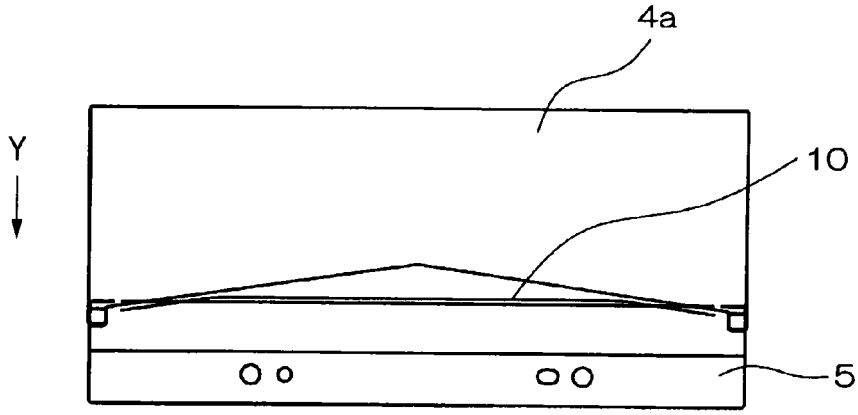
FIG. 5 is a plan view showing a relation among the movable blade, the fixed blade and the paper according to the embodiment of FIG. 1, and shows a state where the paper is being cut.
Figure 6:
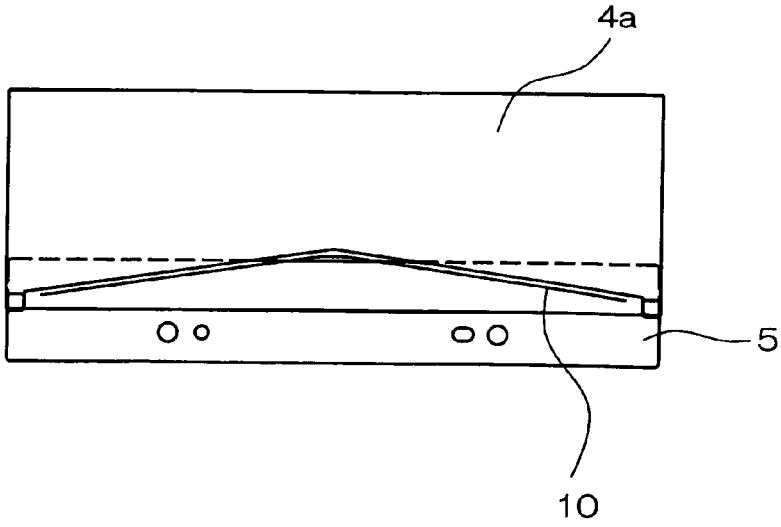
FIG. 6 is a plan view showing a relation among the movable blade, the fixed blade and the paper according to the embodiment of FIG. 1, and shows a state just before completion of the cutting operation.

FIG. 4 is a plan view showing a state where the tip end of the paper 10 is positioned just before a position C shown in FIG. 3, that is, a state where the paper 10 is before being cut. While the movable blade 4*a* is being driven in a direction of an arrow Y shown in FIG. 4 by the DC motor 4*c*, the V-shaped blade edge 4*f* of the movable blade 4*a* starts cutting the paper 10 from both ends thereof with the blade edge portion 5*a* of the fixed blade 5 as shown in FIG. 5. At this time, a cut portion of the paper 10 is moved toward the paper stacking portion 14 side along the surface 5*c* of the fixed blade 5. When the movable blade 4*a* is further driven in the direction of the arrow Y shown in FIG. 5, the V-shaped blade edge 4*f* of the movable blade 4*a* further cuts the paper 10 and stacked in a state shown in FIG. 6. When the blade edge 4*f* of the movable blade 4*a* cuts the paper furthermore, the paper 10 is fully cut off in its width direction. Then, the paper cut off from the paper 10 is entirely pushed into the paper stacking portion 14 by the tip end portion 4*h* having the cross-section H almost perpendicular with respect to the paper push-in direction, then moved to the paper stacking portion 14 side along the downstream side surface 5*c* of the fixed blade 5. The cut-off paper is then stacked on a position shown in FIG. 3. In this way, each cut-off paper can be stacked in order on the paper stacking portion 14 due to a push-in effect of the paper push-in member 14*b* and the action of the movement of the movable blade 4*a*. Incidentally, although the paper 10 is made in a V-shape in its width direction after the tip end portion 4*h* of the movable blade 4*a* during the cutting operation, the paper fully cut off from the paper 10 becomes linear in its width direction at a position of the both ends thereof (portion most moved to the paper guide member 14 side) due to the rigidity thereof at the time of completion of the cutting operation.

In this way, the paper 10 printed by the printing portion 8 is cut by the cutting potion 6 with a set length. The paper fully cut off from the paper 10 is sequentially pushed into the paper stacking portion 14 by the movable blade 4*a*, and stacked. When the cut-off papers having been previously cut off from the paper 10 exists on the paper stacking portion 14, the cut-off paper is pushed into the paper stacking portion 14 pushing the previous cut-off papers toward the paper guide member 14*a*, so all the ledger papers are stacked on the paper stacking portion 14 in order in overlapped manner.

According to the embodiment, the cut-off papers can be stacked in a good order on the paper stacking portion with a simple configuration, without using a particular apparatus for transferring the cut-off papers to the paper stacking portion and also without requiring a special control for the apparatus. Further, since relatively expensive parts such as a roller and a motor for transferring the cut-off papers to the paper stacking portion can be omitted, a paper stacker function can be achieved with relatively cheap parts as compared with a conventional apparatus, which was very expensive.

As described above, the printer according to the invention is particularly useful as a small-sized printer for printing tickets, receipts, slips etc.

The foregoing description of preferred embodiments of the invention has been presented for purposes of illustration and description. It is not intended to be exhaustive or to limit the invention to the precise form disclosed, and modifications and variations are possible in light of the above teachings or may be acquired from practice of the invention. The embodiments were chosen and described in order to explain the principles of the invention and its practical application to enable one skilled in the art to utilize the invention in various embodiments and with various modifications as are suited to the particular use contemplated. It is intended that the scope of the invention be defined by the claims appended hereto, and their equivalents.

What is claimed is:

1. A printer comprising:

a cutting portion including a plate-shaped fixed blade, a plate-shaped movable blade and a driving unit, which drives the movable blade back and forth with respect to the fixed blade; and a paper stacking portion for stacking a cut-off paper thereon, which is provided on a downstream side of a paper transfer direction with respect to the cutting portion on the fixed blade side, wherein the movable blade is disposed on the downstream side with respect to the fixed blade and configured to move toward the fixed blade to cut a paper, and a tip end portion of the movable blade is configured to have a surface almost perpendicular with respect to a direction in which the surface pushes the paper toward the paper stacking portion.

2. The printer according to claim 1, wherein a blade edge of the movable blade forms a V-shape in manner of that both sides thereof are led toward the fixed blade from a center portion thereof.

3. The printer according to claim 1, further including a paper push-in member which is provided on the downstream side with respect to the cutting portion and protrudes toward the paper stacking portion.

4. A printer comprising:

a cutting portion including a plate-shaped fixed blade, a plate-shaped movable blade, which cuts a paper with the fixed blade by an approach movement toward the fixed blade in a overlapping state, and a driving unit, which drives the movable blade back and forth with respect to the fixed blade;

a paper stacking portion for stacking a cut-off paper thereon, which is provided on a downstream side of a paper transfer direction with respect to the cutting portion; and a moving portion for moving the cut-off paper to the paper stacking portion, wherein the moving portion moves the cut-off paper to the paper stacking portion along a downstream side surface of the fixed blade in accordance with a movement of the cutting portion.

5. The printer according to claim 4, wherein the moving portion is configured with the movable blade.

6. The printer according to claim 5, wherein a blade edge of the movable blade forms a V-shape in manner of that both sides thereof are led toward the fixed blade from a center portion thereof.

7. The printer according to claim 5, further including a paper push-in member which is provided on the downstream side with respect to the cutting portion and protrudes toward the paper stacking portion.

8. The printer according to claim 4, wherein a blade edge of the movable blade forms a V-shape in manner of that both sides thereof are led toward the fixed blade from a center portion thereof.

9. The printer according to claim 4, further including a paper push-in member which is provided on the downstream side with respect to the cutting portion and protrudes toward the paper stacking portion.

* * * * *